US005203987A

United States Patent [19]

de la Fuente

[11] Patent Number: 5,203,987

[45] Date of Patent: Apr. 20, 1993

[54] METHOD OF UPGRADING RESIDUA

[75] Inventor: Emiliano de la Fuente, Yorba Linda, Calif.

[73] Assignee: Union Oil Company of California, Los Angeles, Calif.

[21] Appl. No.: 694,225

[22] Filed: Apr. 5, 1991

[51] Int. Cl.[5] ..... C01G 65/00; C01G 65/14; C01G 45/00; C01G 59/06

[52] U.S. Cl. ..... 208/59; 208/58; 208/80; 208/89; 208/94

[58] Field of Search ..... 208/58, 59, 80, 89, 208/94

[56] References Cited

U.S. PATENT DOCUMENTS 4,675,274 8/1979 Kwant ..... 208/80

*Primary Examiner*—Theodore Morris

*Assistant Examiner*—P. L. Hailey

*Attorney, Agent, or Firm*—Charles L. Hartman; Gregory F. Wirzbicki

[57] ABSTRACT

Residua comprises upgraded by first partitioning a hydrocracked residua into a vapor fraction and a liquid fraction. The vapor fraction is hydrotreated forming a first hydrotreated product. The liquid fraction is partitioned into a residua fraction and a light liquid fraction. The light liquid fraction can be hydrotreated or hydrocracked to form a hydroprocessed product. The hydrotreated product and the hydroprocessed product are then combined forming a substantially upgraded synthetic crude product refinable as a routine crude in a refinery into products that meet stringent specifications. In particular, residua can be upgraded to make a quality jet fuel fraction and a naphtha fraction containing less than 1 ppmw sulfur and nitrogen.

27 Claims, 1 Drawing Sheet

METHOD OF UPGRADING RESIDUA

BACKGROUND OF THE INVENTION

1. Field of the Invention

This invention relates to methods of upgrading the products derived from the cracking of residua in petroleum refining, particularly methods involving upgrading non-catalytic hydrocracked residua, and especially methods of hydroprocessing hydrocracked residua.

2. State of the Art

Modern requirements for petroleum products place a premium on light, clean burning transportation fuels. Such fuels should be low in sulfur, metals, nitrogen, and aromatic compounds. New requirements place limits on the concentrations of sulfur that can be present in diesel fuel, and requirements for a low smoke point place restrictions on total aromatic compounds allowed in jet fuel. A continuing problem for refiners is producing as much valuable light transportation fuels from crude as possible that meet all relevant specifications.

A particular problem has always been the treatment of residua, the portion of a distilled crude left in the pot after distillation, residua usually being defined as the portion that boils at greater than 560° [C. (1050° F.). Residual are heavy and contain most of the material that degrades the quality of petroleum, for example, metals and sulfur, as well as high molecular weight polynuclear aromatic compounds. High quality light crudes that produce less residua are becoming more scarce in the world, and the heavy crudes remaining tend to make more residua when refined. For example the tar sands of Canada, heavy Mayan crude, Venezuelan crude, and Arabian heavy all produce an abundance of residua when processed. Consequently, refiners increasingly have to face the problem of how to upgrade more residua into a commercial product. It is important that as much residua be turned into naphtha, jet fuel, diesel, and other light transportation fuels as possible.

One method for upgrading residua is shown in U.S. Pat. No. 4,851,107 issued to Kretschamar et al. That process teaches that a fuel, for example, jet fuel (boiling range 150° C.-355° C. (300° F.-520° F.)), is produced by catalytically hydrocracking the entire residua fraction and then subjecting most of the hydrocrackate product to hydroprocessing under severe conditions. The heaviest portion of the hydrocrackate is not hydroprocessed at all, but is combined with the treated lighter portion. Then the combined product is refined as a synthetic crude to produce the fuel products.

However, the treatment described in U.S Pat. No. 4,851,107 presents several problems. First, the heavier portion of the hydroprocessed fraction tends to be cracked during hydroprocessing under severe conditions. This results in the production of large concentrations of light sulfur, nitrogen, and aromatic components, fragments derived from the heavier components of the feed, being included in the lighter boiling fractions. Therefore, the final jet fuel product may not meet the quality jet fuel specification of including no more than 20 vol.% aromatic content. If the hydrotreating conditions are severe enough the quality jet fuel specification may be met, but at the price of creating a naphtha fraction that has too much sulfur and nitrogen to be a suitable reformer feedstock. A reformer feedstock should have less than one part per million of both sulfur and nitrogen.

Second, the hydrocrackate contains components of widely varying molecular weights and boiling points. Therefore, the conditions for hydroprocessing most of the various components of the hydrocrackate cannot be optimized. Consequently, portions of the hydrocrackate feed can be "over" processed, destroying desired components, whereas other portions may not be processed enough to produce the desired products. Furthermore, the extremely severe temperatures and pressures required to upgrade the hydrocrackate to meet the quality jet fuel specification are generally expensive, making the process less economical. Finally, combining an unhydrotreated fraction with a hydrotreated fraction tends to introduce more aromatic components into the final products.

Accordingly catalytically hydroprocessing the entire hydrocracked residua has many drawbacks. It results in an expensive process that yields a product that, while boiling in the jet fuel range, does not meet quality jet fuel aromatic specifications. Clearly, a process that produces a better quality jet fuel from residua is needed, preferably one that is more economical to operate.

SUMMARY OF THE INVENTION

Residuum is upgraded in the process of this invention by first partitioning a hydrocracked residua into a vapor fraction and a liquid fraction. The vapor fraction is hydrotreated, forming a hydrotreated product. The liquid fraction is partitioned into a residua fraction and a light liquid fraction. The light liquid fraction can be hydrotreated or hydrocracked, forming a hydroprocessed product. The hydrotreated product and the hydroprocessed product are then combined.

The process of the present invention allows upgrading hydrocracked residua, or similar feedstocks, to make, for example, quality jet fuel (defined herein to as containing 20 vol.% or less aromatic content). Because the feed of the present invention is fractionated, each fraction can be hydroprocessed under relatively mild conditions, which prevent the heavier, higher boiling portions of the fractions from being excessively cracked. The sulfur and nitrogen concentrations are low enough to allow reforming the product. Therefore, the portion of the product of this invention in the jet fuel range will typically and preferably contain no more than 20 vol.% aromatic content. Moreover, the naphtha fraction meets the sulfur and nitrogen specification for a suitable reformer feedstock.

Each of the two hydroprocessed fractions contains components whose molecular weights and boiling points are in a relatively narrow range. Therefore, the hydroprocessing conditions can be optimized for each fraction, producing and preserving more of the desired product components.

The relatively mild conditions that can be used in the process of the invention are economical to use. The process of the present invention is a less expensive process that produces both a quality jet fuel and a suitable reformer feedstock.

In general, this invention allows a refiner to upgrade hydrocracked residua. The apparatus and process of this invention are easily integrated with a system or process that produces the non-catalytically hydrocracked residua feedstock. Although the process of this invention can be run at substantially the same pressure as the hydrocracked residua producing step, the refiner still has opportunity to optimize conditions in each hydroprocessing step to most effectively process the two fractions. Specifically the refiner may use different catalysts, different residence times, and temperature in the catalytic beds. This invention provides the refiner with a method to produce a refinable synthetic crude product. By optimizing the hydroprocessing conditions the refiner can produce a synthetic crude product that will allow the production of high quality naphtha or middle distillate products.

BRIEF DESCRIPTION OF THE DRAWING

The FIG. shows a schematic flow diagram of the present invention.

DETAILED DESCRIPTION OF THE INVENTION

Figure 1:
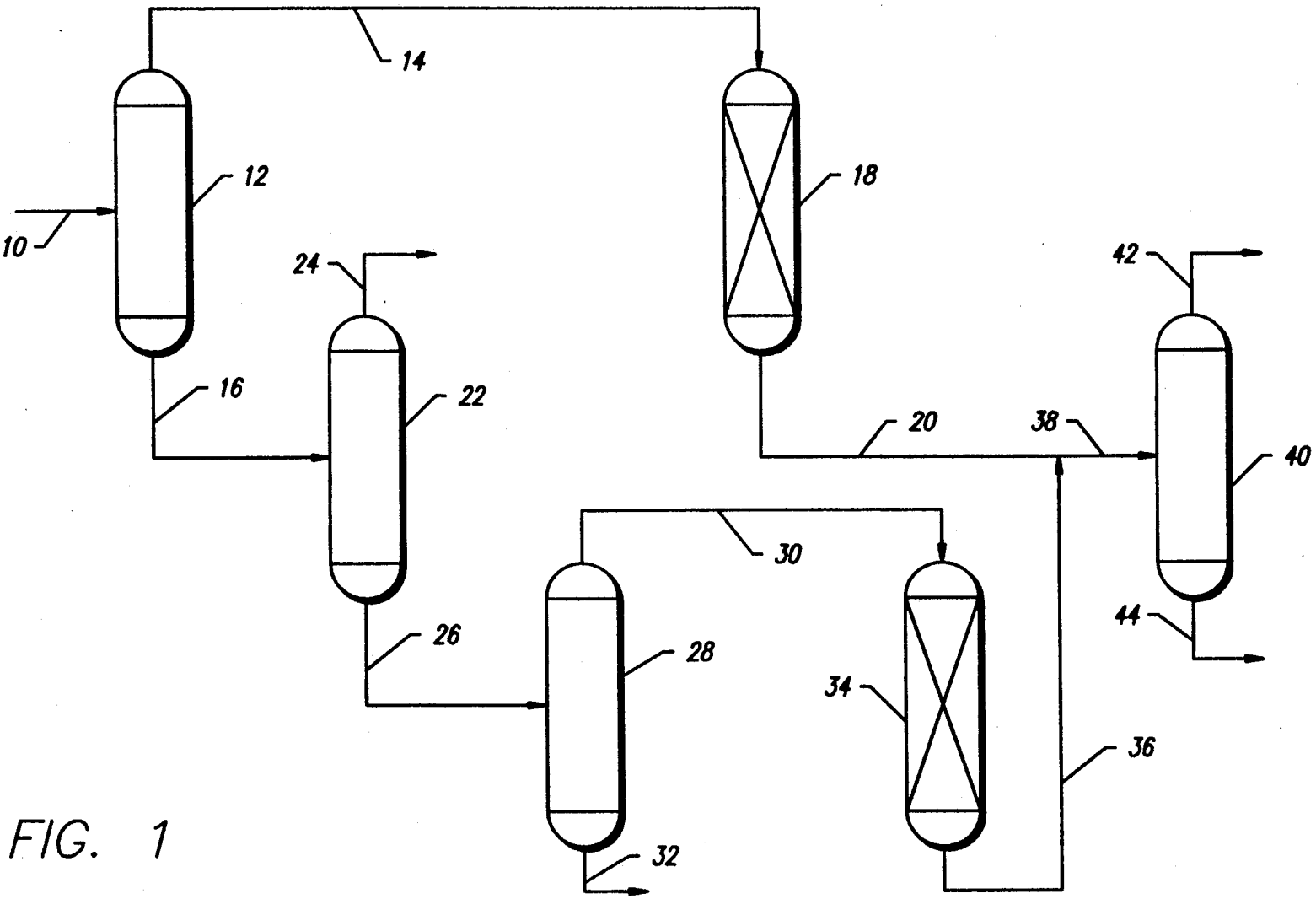

The feedstock of this invention is a hydrocracked vacuum or atmospheric residua. The process to make the hydrocracked residua can be catalytic or non-catalytic. Normally, to make a feedstock for this process, a residua is heated to between 250° C. and 500° C. in the presence of between 350 and 750 psia hydrogen either a) in the presence of a conventional hydroprocessing catalyst, b) a particulate material, such as coal or charcoal dust, iron oxide dust or small particles, or some other small particles, or c) no catalyst or particles to provide a feedstock of this invention. A residua subjected to hydrovisbreaking yields one such feedstock, as does a residua subjected to a temperature greater than 450° C. at hydrogen pressures of greater than 750 psia in a vessel with no catalyst. The "catalytic" step described in U.S. Pat. 4,851,107 issued to Kretschamar et al. results in another such feedstock. These feedstocks contain components boiling over a wide temperature range, with the exact boiling point distribution in any given case being highly dependent on the nature of the resid and the severity of the operating conditions. Typically, the feedstock contains at least 5 wt.%, often more than 10 wt.%, sometimes more than 20 wt.%, but usually no more than about 30 wt.% of components boiling over 550° C. (1050° F.). The feedstock normally comprises at least 10 wt.%, usually no more than 20 wt.%, but generally no greater than 30 wt.% of components boiling below 85° C. (185° F.). The weight percentages of components boiling below about 176° C. (300° F.) is, of course, somewhat higher than that boiling below 85° C. (185° F.), with the values typically being at least 15 wt.%, often at least 30 wt.%, but generally less than 50 wt.% for the 176° C.+(300° F.+) fraction. The feedstock also generally contains relatively large concentrations of sulfur, nitrogen, metals, asphaltenes and heavy aromatic components. The asphaltenes, metals and the like tend to be concentrated in the 1050° F.+fraction.

Such a feedstock needs further refining to produce commercial products. In the specification and claims that follow the naphtha fraction is that fraction containing $C_5$ and heavier molecules boiling below 176° C. (350° F.), the jet fuel fraction is that fraction boiling between 176–260° C. (350–500° F.), the diesel fraction is that fraction boiling between 176–343° C. (350–650° F.), and the gas oil fraction is that fraction boiling at over 343° C. (650° F.).

The feedstock in line 10 is introduced to a hot, high pressure fractionator 12, maintained at a separation temperature between about 295 and 395° C. (563° and 743° F.), preferably between about 320° and 395° C. (608° and 743° F.), and most preferably between about 330° and 360° C. (626° and 680° F.). Two product fractions are formed. A vapor fraction boils below the separation temperature and comprises between about 35 and 80 vol.% of the cracked residua product, preferably between about 50 and 70 vol.%. A liquid fraction boils above the separation temperature. The vapor fraction is removed overhead the separator through line 14 while the liquid fraction is withdrawn at the bottom of the separation vessel through line 16. The fractionator can be crude with few internal baffles, but such a crude fractionator results in concentrations of material in each fraction that properly belong in the other fraction.

The vapor fraction typically contains lower concentrations of aromatic components than the liquid fraction. For example, the vapor fraction usually contains less than 30 vol.%, preferably less than 25 vol.%, and most preferably less than 20 vol.% aromatic components. Typical ranges for the vapor fraction, and its components, assuming a 650° F. separation temperature, are shown in Table 1.

TABLE 1

| | Typical Range | Preferred Range |
|---|---|---|
| Full Range Gaseous Fraction | | |
| Gravity, °API | 25–50 | 25–35 |
| Sulfur, wt. % | 0.5–3.0 | 1.5–2.25 |
| Nitrogen, wt. % | 0.01–0.5 | 0.1–0.38 |
| X-85° C. (X-185° F.) Fraction | | |
| Vol. % of vapor fraction | 0–20 | 10–15 |
| Sulfur, wt. % | 0.05–0.5 | 0.1–0.25 |
| Nitrogen, ppm | 400–1600 | 600–1000 |
| 85–176° C. (185–350° F.) Fraction | | |
| Vol. % of vapor fraction | 0–32 | 8–25 |
| Sulfur, wt. % | 0.5–2.0 | 0.75–1.5 |
| Nitrogen, ppm | 900–3600 | 1500–2400 |
| Jet Fuel Fraction | | |
| Vol. % of vapor fraction | 7.5–30 | 10–20 |
| Sulfur, wt. % | 0.4–5.0 | 1.0–2.5 |
| Nitrogen, wt. % | 0.1–0.4 | 0.15–0.3 |
| Aromatics | 15–60 | 20–35 |
| 260–343° C. (500–650° F.) Fraction | | |
| Vol. % of vapor fraction | 15–80 | 20–35 |
| Diesel Fraction | | |
| Vol. % of vapor fraction | 25–90 | 35–55 |
| Sulfur, wt. % | 1.0–5.0 | 1.5–3.0 |
| Nitrogen, wt. % | 0.025–0.7 | 0.25–0.40 |
| Aromatics, wt. % | 15–40 | 20–35 |
| Gas Oil Fraction | | |
| Vol. % of vapor fraction | 12–50 | 15–30 |
| Sulfur, wt. % | 1.0–4.5 | 1.5–3.0 |
| Nitrogen, wt. % | 0.35–1.5 | 0.5–1.00 |

Note:
The fractionation is relatively crude, resulting in a high concentration of 650° F.+ material in the vapor fraction.

The vapor fraction is greatly in need of further refining. Its component fractions are of very low quality and cannot be readily used as commercial products. Typically, the vapor fraction of the feed contains too high a concentration of aromatic components in the fraction boiling in the jet fuel range to be a quality jet fuel. However, by excluding the heavier distillate components, which remain in the hot separator liquid, the vapor fraction can be hydrotreated by relatively milder conditions to remove sulfur, nitrogen, and aromatic components to yield a jet fuel meeting the quality jet fuel specifications than if the heavy fraction was not removed. At the same time the sulfur and nitrogen levels in the naphtha range material can be lowered to less than 1 ppmw at relatively lower severities of hydroprocessing conditions.

The vapor fraction is passed directly to a catalytic reactor 18 charged with a hydrotreating catalyst such as a catalyst comprising a Group VIII and a Group VIB metal supported on a suitable refractory oxide. Preferred Group VIII metals include nickel and cobalt, and preferred Group VIB metals include molybdenum and tungsten. Suitable refractory oxides include alumina, silica-alumina, silica, titania, magnesia, zirconia, beryllia, silica-magnesia, silica-titania and other similar combinations. The catalyst can be made by conventional methods including impregnating a preformed catalyst support. Other methods include cogelling, comulling, or precipitating the catalytic metals with the catalyst support followed by calcination. The preferred catalyst is nickel and molybdenum supported on alumina.

The vapor fraction is contacted with the catalyst at a temperature between about 200 and 600° C. (430 and 1112° F.), preferably between about 230 and 480° C. (446 and 896° F.), in the presence of hydrogen at a pressure between 6.8 and 34.5 MPa (1000 and 5000 psia), preferably between 10.3 and 20.7 MPa (1500 and 3000 psia), most preferably between 12.1 and 17.2 MPa (1750 and 2500 psia). As a result of the hydrotreating, organosulfur is converted to hydrogen sulfide and organonitrogen is converted to ammonia. Some olefins and some aromatic compounds are hydrogenated as well, bringing the product into the range needed to meet quality jet fuel aromatics specification. The hydrotreated product from the hydrotreating reactor, whose analysis is shown in Table 2, is withdrawn through line 20. Note that the jet fuel fraction meets the quality jet fuel specification and that the naphtha fraction meets the nitrogen specification for a suitable reformer feedstock.

TABLE 2

| | Spec | Typical Range | Preferred Range |
|---|---|---|---|
| Naphtha, $C_5$–350° F. | | | |
| Nitrogen, ppmw | <1 | <0.1–0.8 | 0.2–0.5 |
| Sulfur, ppmw | — | <0.5–3.0 | 0.5–1.0 |
| Jet Fuel, 300–500° F. | | | |
| Aromatics, vol. % | 22 | 7.0–20 | 12–18.5 |
| Smoke point, min | >20 | 20–25 | 22–25 |
| Diesel, 350–650° F. | | | |
| Motor cetane | >40 | 40–50 | 42–47 |
| Vacuum Gas Oil, 650° F.+ | | | |
| Nitrogen, ppmw | <1000 | <0.1–15 | <0.1–5 |

Line 16 introduces the liquid fraction to a low pressure, high temperature liquid/gas separator 22 which removes what gases may be entrained in the liquid fraction. The gases are removed and sent to gas recovery elsewhere in the refinery through line 24. The degassed liquid fraction is removed from the bottom of the separator 22 through line 26.

Line 26 introduces the degassed fraction to a vacuum distillation column 28 maintained at a pressure between about 1.67 and 10.02 KPa (0.5 and 6 inches of Hg), preferably between about 3.38 and 6.68 KPa (1 and 2 inches of Hg) at a vacuum distillation temperature between 250 and 500° C. (482 and 932° F.), preferably between 300 and 450° C. (572 and 842° F.), and most preferably between about 350 and 400° C. (662 and 752° F.). Two fractions are separated: a light liquid fraction and a residua fraction. The light liquid fraction, which can be considered to be a heavy gas oil, is a fraction boiling at between the separation temperature and the vacuum distillation temperature, and has the analysis shown in Table 3.

TABLE 3

| | Typical Range | Preferred Range |
|---|---|---|
| Light Liquid Fraction | | |
| Sulfur, wt. % | 1.35–7.80 | 2.0–4.0 |
| Nitrogen, wt. % | 0.08–1.5 | 0.15–1.0 |
| Aromatics, wt. % | 25–60 | 25–50 |
| X-343° C. (X-650° F.) Fraction | | |
| Vol. % of feedstock | 8.0–35 | 10–25 |
| Sulfur, wt. % | 1.5–6.0 | 2.5–3.5 |
| Nitrogen, wt. % | 0.2–1.0 | 0.3–0.75 |
| 343° C.+ (650° F.+) Fraction | | |
| Vol. % of Feedstock | 65–92 | 75–90 |
| Sulfur, wt. % | 1.25–5.5 | 2.0–4.0 |
| Nitrogen, wt. % | 0.4–1.5 | 0.5–1.0 |
| Aromatics, wt. % | 20–70 | 25–50 |

Note:
The fractionation is relatively crude, resulting in a high concentration of 650° F.– material in the liquid fraction.

The light liquid fraction preferably forms between 15 and 50 vol.% of the feedstock, more preferably about 25 and 40 vol.%. The light liquid fraction is withdrawn overhead through line 30, and the residua fraction is withdrawn from the bottom in line 32.

The residua fraction produced in vacuum column 28 is of poor quality, and is preferably used for fuel oil, road oil, or similar low value products. It is generally not suitable as a feedstock for recycling to the non-catalytically hydrocracking step of this invention. Frequently, an additive is added to the residua in the non-catalytic cracking process used to make the feedstock of this invention to prevent excess coking. If a coking preventing additive were added in the non-catalytic hydrocracking step, then all or part of the residua fraction can be recycled to the non-catalytic hydrocracking step recover as much additive as possible.

The light liquid fraction from distillation column 28 usually contains a large concentration of aromatic components as shown in Table 3. The light liquid fraction is subjected to hydroprocessing in reactor 34. The type of hydroprocessing can be hydrotreating, hydrocracking, or a combination of hydrotreating followed by hydrocracking hereinafter referred to as "integral operation". The selection of which one is at the discretion of the refiner. If the refiner desires more naphtha and light products, or middle distillates, for example jet fuel or diesel, he usually hydrocracks the light liquid fraction. Other heavier products can be made by hydrotreating the light liquid fraction. Integral operation can provide light products and middle distillates containing low concentrations of aromatic components. In particular, integral operation has the advantage of eliminating the light aromatic components formed by cracking the light liquid fraction. It is possible to obtain a middle distillate product having low concentrations of aromatics that meet quality jet fuel specifications.

If the liquid fraction from distillation column 28 were to be hydrotreated, it would be contacted with a second hydrotreating catalyst in reactor 34 generally under conditions as herein previously described. It will be appreciated that the specific conditions may be different than those previously described for reactor 18, although the conditions will be in the ranges previously described. The light liquid fraction is contacted with the catalyst maintained at a temperature between about 230° C. and 480° C. (446° F. and 896° F.) in the presence of hydrogen at a pressure between 6.8 and 34.5 MPa (986 and 5000 psia), preferably between 10.3 and 20.7

MPa (1500 and 3000 psia), and most preferably between 12.1 and 17.2 MPa (1750 and 2500 psia) at the system pressure. Some olefins and some aromatic compounds in the feedstock are saturated and what organosulfur might be present is converted to hydrogen sulfide, and the organonitrogen is converted to ammonia. The volumetric analysis of the hydrotreated light liquid fraction is shown in Table 4.

It will be noticed that in Table 4 most of the product is a gas oil, and only a small amount of lighter products have been produced. The primary use for gas oils is as a feedstock for fluidized catalytic cracking (FCC) units. To be an acceptable feedstock, the gas oil must not contain more than about 5000 ppmw nitrogen, preferably less than 1000 ppmw. The gas oil produced by this method meets this specification, but the untreated gas oil of the prior art, which contains as much nitrogen as the feed shown in Table 3, or as much as 1.5 wt.% nitrogen, clearly does not.

TABLE 4

| | Typical Range | Preferred Range |
|---|---|---|
| Naphtha, vol. % | 0.5–3.00 | 1.0–2.5 |
| Jet Fuel, vol. % | 1.5–6.0 | 2.0–4.0 |
| Diesel, vol. % | 9–36 | 15–25 |
| Gas Oil, vol. % | 50–90 | 75–90 |

Turbine fuel, diesel fuel, and other middle distillates, as well as lower boiling liquids, such as naphtha and gasoline, can be produced by hydrocracking heavy gas oils, such as the light liquid fraction in reactor 34. Although the operating conditions within a hydrocracking reactor have some influence on the yield of the products, the hydrocracking catalyst is the prime factor in determining the yield of the product slate. However in the practice of this invention, the hydrocracking catalyst selected is usually a highly active hydrocracking catalyst. The amount of conversion is then controlled by regulating the temperature of the hydrocracking catalyst. But, for special needs the refiner can select a lower activity, more selective hydrocracking catalyst which selectively produce middle distillate fractions, such as jet fuel and diesel fuel. If the refiner desires naphtha, he selects hydrocracking catalysts which selectively produce lighter products, for example, naphtha. The light liquid fraction is contacted with a suitable hydrocracking catalyst under conditions of elevated temperature and pressure in the presence of hydrogen so as to yield a product containing a distribution of hydrocarbon products desired by the refiner.

If one desires to maximize the amount of jet fuel produced by this invention, then one selects a suitable hydrocracking catalyst for hydrocracking the light liquid fraction. Suitable catalysts are described in U.S. Pat. Nos. 4,062,809 and 4,419,271, the disclosures of which are hereby incorporated by reference in their entireties. These patents disclose two very effective middle distillate hydrocracking catalysts. The catalyst of U.S. Pat. No. 4,062,809 contains molybdenum and/or tungsten plus nickel and/or cobalt on a support of silica-alumina dispersed in gamma alumina. U.S. Pat. No. 4,419,271 teaches that the catalyst of U.S. Pat. No. 4,062,809 can be improved by adding an aluminosilicate zeolite to the support, thereby producing a catalyst containing molybdenum and/or tungsten and nickel and/or cobalt supported on a mixture of an aluminosilicate zeolite, preferably an ultrahydrophobic zeolite known as LZ-10 zeolite, in combination with a dispersion of silica-alumina in a gamma alumina matrix. The presence of the zeolite in this catalyst increases the activity of the catalyst without significantly affecting the selectivity. A typical analysis for a light liquid fraction treated with a hydrocracking catalyst is shown in Table 5. Note that the amounts of sulfur and nitrogen are low enough to meet the specification for a suitable reformer feedstock and that the aromatic component concentration of the jet fuel fraction is met within the preferred range.

TABLE 5

| | Typical Range | Preferred Range |
|---|---|---|
| Naphtha | | |
| Vol. % of product | 10–40 | 15–30 |
| Sulfur, ppmw | 0.5–2.0 | 0.75–1.5 |
| Nitrogen, ppmw | 0.05–0.2 | 0.07–0.15 |
| Aromatics, wt. % | 5.0–20 | 7.5–15 |
| Diesel | | |
| Vol. % of product | 20–80 | 30–55 |
| Sulfur, ppmw | 5.0–20 | 7.5–15 |
| Nitrogen, ppmw | 1.0–5.0 | 1.5–3.5 |
| Cetane Index | 40–50 | 42–47 |
| Jet Fuel | | |
| Vol. % of product | 10–40 | 15–30 |
| Sulfur, ppmw | 2.5–10 | 3.0–7.5 |
| Nitrogen, ppmw | 0.5–2.0 | 0.7–1.5 |
| Aromatics, wt. % | 15–25 | 18–22 |
| Vacuum Gas Oil | | |
| Vol. % of product | 25–75 | 35–60 |
| Sulfur, ppmw | 10–40 | 15–30 |
| Nitrogen, ppmw | 1.5–7.5 | 1.0–4.5 |

If one desires to maximize the amount of gasoline and naphtha produced by this invention, then one selects a different hydrocracking catalyst for hydrocracking the light liquid fraction. A suitable catalyst is described in U.S. Pat. No. 3,929,672 issued to Ward, the disclosure of which is hereby incorporated by reference in its entirety. U.S. Pat. No. 3,929,672 discloses a hydrocracking catalyst having a Group VIII metal, a Group VIB metal and a hydrothermally stabilized Y zeolite supported on alumina. This catalyst promotes production of gasoline or naphtha when used in the hydroprocessing reactor.

In yet a third alternative embodiment for treating the light liquid fraction from distillation column 28, it can be subjected to integral operation, where reactor 34 contains a bed of hydrotreating catalyst and a bed of hydrocracking catalyst. In this embodiment the third light liquid fraction is first contacted with a suitable hydroprocessing catalyst as herein described previously, such as a Group VIII metal component and a Group VIB metal component on a porous, inorganic refractory oxide support most often composed of alumina and containing no zeolite or molecular sieves, and under suitable conditions, including an elevated temperature and the presence of hydrogen. For example, suitable conditions include temperature between about 200° and 535° C. (392° and 995° F.) in the presence of hydrogen at a pressure between 6.8 and 34.5 MPa (986 and 5000 psia), preferably between 10.3 and 20.7 MPa (1500 and 3000 psia), and most preferably between 12.1 and 17.2 MPa (1750 and 2500 psia). In the hydrotreating zone, organonitrogen components contained in the feedstock are converted to ammonia and the organosulfur components are converted to hydrogen sulfide. Subsequently, the entire effluent from the hydrotreating zone is treated in a hydrocracking zone maintained under suitable conditions of elevated temperature, at the system pressure, and containing a hydrocracking catalyst predetermined by the refiner to give the desired product slate, such that a substantial conversion of high boiling feed components to the desired product components is obtained. Although the hydrotreating and hydrocracking zones in integral operation can be maintained in separate reactor vessels, in the process of this invention it is preferred to employ a single, downflow reactor vessel containing an upper bed of hydrotreating catalyst particles and a lower bed of hydrocracking particles. A preferred example of integral operation may be found in U.S. Pat. No. 3,338,819 issued to Wood which discloses a process for integral operation that includes a second hydrotreating zone after the hydrocracking zone.

The second catalytic reactor 34 produces a hydroprocessed fraction that is removed through line 36. The hydrotreated product in line 20 and the hydroprocessed product in line 36 are then combined, forming a synthetic crude product in line 38 that can be processed as normal crude in the refinery. The synthetic crude product is characterized by greatly reduced concentrations of sulfur, nitrogen, and aromatic components as shown in Tables 2, 4 and 5. It usually contain, for example, less than 20 vol.% aromatic components, and preferably less than 15 vol.% aromatic components. It is preferred that a high pressure, cold gas/liquid separator 40 be used to remove the various gases entrained with the product. For example, any hydrogen sulfide or ammonia that may be entrained with the product is removed. The gases are removed through line 42 and the finished product is removed to the refinery in line 44.

It will be noticed that the jet fuel fraction of the hydroprocessed product obtained by hydrocracking and shown in Table 5 is marginal for meeting the quality jet fuel aromatic specification. However, because this hydroprocessed product is mixed with the hydrotreated product shown in Table 2, and the final jet fuel fraction produced in line 44 easily meets the aromatic specification for quality jet fuel. In contrast, if the entire feedstock in line 10 were to have been all hydrocracked, as suggested in the prior art, the low quality residua portion would have been cracked producing large concentrations of aromatic components boiling in the jet fuel range. That product could not have met the aromatic specification.

In a preferred embodiment all the high pressure steps in this process are run at the same pressure. The pressure of all the high pressure vessels of the apparatus of this invention is usually between 6.8 and 34.5 MPa (986 and 5000 psia), preferably between 10.3 and 20.7 MPa (1500 and 3000 psia), most preferably between 12.1 and 17.2 MPa (1750 and 2500 psia). Thus, the pressure of hot, high pressure separator 12, the catalytic reactor 18, and the second catalytic reactor 34 are preferably at the same pressure. The process is then simplified, since only one pressure need be maintained. The only drops in pressure are at the gas liquid separator 22 and the vacuum distillation column 28. The pressures throughout the system are approximate and subject to the normally expected pressure drop across the catalyst beds.

This invention is intended to include many modification and additions. For example although the preferred embodiment as discussed above uses a single gas/liquid separator for removing hydrogen sulfide and ammonia from line 28. However one could use, as in Example 1, a separate gas/liquid separator for each product line prior to their combination.

EXAMPLES

The invention is further described by the following examples which are illustrative of various aspects of the invention and are not intended as limiting the scope of the invention as defined by the appended claims.

EXAMPLE 1

In this example a residuum feedstock boiling above 560° C., containing more than 1.0 wt.% sulfur, more than 1000 ppmw nitrogen and having at least 50 vol.% pentane insoluble components is hydrocracked by heating the feedstock to about 550° C. (1022° F.) in the presence of hydrogen. The pressure of this non-catalytic hydrocracking step is 13.6 MPa (2000 psia) pressure. The cracked residua product is cooled to about 345° C. (653° F.) in a separator at non-catalytic hydrocracking pressure. A vapor fraction is separated from a liquid fraction.

The vapor fraction is contacted with a catalyst containing between about 3.7 and 4.5 wt.% nickel (measured as NiO) and between about 24.0 and 27.0 wt.% molybdenum (measured as $MoO_3$) on an amorphous alumina support (hereinafter referred to as "catalyst A"). The processing conditions are 370° C. and 400° C. (698° F. and 752° F.), a pressure of about 13.6 MPa (2000 psia) pressure, and a LHSV of 0.4 and 0.7 $hr^{-1}$. The ammonia and the hydrogen sulfide produced are removed using a gas/liquid separator, yielding a hydrotreated product.

The liquid fraction is sent to a low pressure, hot separator where any entrained gas is removed. The degassed liquid fraction is then vacuum distilled in a vacuum distillation column. The pressure of the column is about 6.68 KPa (2.0 inches of Hg) and the temperature is 345° C. (653° F.). A light liquid fraction is separated from a residua stream. The residua stream is discarded.

The light liquid fraction is hydrotreated by contacting it with catalyst A at 380° C. (716° F.), at a pressure of about 13.6 MPa (2000 psia) pressure and a LHSV of 1.0 $hr_{-1}$. The resulting hydrotreated product from this reaction has the ammonia and the hydrogen sulfide produced removed using a gas/liquid separator.

The hydrotreated product and the hydroprocessed product are then combined forming a synthetic crude product for further refining.

EXAMPLE 2

In this example the light liquid fraction from Example 1 is hydrocracked, instead of being hydrotreated, by contacting it with a catalyst containing 15 wt.% molybdenum (minimum, measured as $MoO_3$), 5 wt.% nickel (measured as NiO), and 60 wt.% hydrothermally stabilized Y zeolite dispersed in an alumina gel matrix (substantially the catalyst as described in U.S. Pat. No. 3,929,672, Example 18 and hereinafter referred to as "catalyst B"). The processing conditions are 345° C. (653° F.), at a pressure of about 13.6 MPa (2000 psia) pressure, 2137.2 cc $H_2$/ml oil (12,000 SCF $H_2$/bbl), and a space velocity between 2.0 and 4.0 $hr^{-I}$ LHSV. The second hydrotreated product is then removed.

What is claimed is:

1. A method for upgrading a hydrocracked residua comprising:

separating a hydrocracked residua into a first fraction and a second fraction containing between 25 and 50 wt.% aromatic components;

catalytically hydrotreating the first fraction to produce a hydrotreated product;

distilling the second fraction under vacuum, at a pressure comprising between about 1.67 KPa and 10.02 KPa (0.5 and 6 inches of Hg) to produce a third fraction and at a residua fraction;

catalytically hydroprocessing the third fraction to produce a hydroprocessed product; and combining said hydrotreated product with said hydroprocessed product producing a fuel product containing no more than 25 vol.% aromatic components.

2. The method of claim 1 wherein the first fraction contains no more than 20 vol.% aromatic components, 3.0 wt% sulfur containing components, and 0.38 wt% nitrogen containing components, the second fraction contains at least 50 vol.% aromatic components, at least 4.0 wt% sulfur containing components, and at least 1.0 wt% nitrogen containing components and the fuel product contains no more than 25 vol.% aromatic components, and includes a naphtha fraction containing no more than 1 ppmw sulfur containing components, and 1 ppmw nitrogen containing components.

3. The method of claim 1 wherein the separation step comprises heating a hydrocracked residua to a temperature between about 295° and 395° C. (563° and 743° F.) to produce a gaseous first fraction and a liquid second fraction.

4. The method of claim 1 wherein said hydrotreating step comprises contacting the first fraction with a catalyst comprising a group VIII metal and a Group VIB metal supported on a refractory oxide.

5. The method of claim 4 wherein said Group VIII metal is selected from the group consisting of nickel and cobalt, and a Group VIB metal is selected from the group consisting of molybdenum and tungsten.

6. The method of claim 4 wherein said refractory oxide is selected from the group consisting of alumina, silica-alumina, silica, titania, magnesia, zirconia, beryllia, silica-magnesia, and silica-titania.

7. The method of claim 1 including degassing the second fraction before separating the second fraction on the vacuum distillation means.

8. The method of claim 1 wherein the hydroprocessing step comprises processing the third fraction in a hydrotreating reactor.

9. The method of claim 8 wherein said hydrotreating reactor contains a hydrotreating catalyst having Group VIII metal and a Group VIB metal supported on a refractor oxide.

10. The method of claim 9 wherein said Group VIII metal is selected from the group consisting of nickel and cobalt, and a Group VIB metal is selected from the group consisting of molybdenum and tungsten.

11. The method of claim 9 wherein said refractory oxide is selected from the group consisting of aluminia, silica-alumina, silica, titania, magnesia, zirconia, beryllia, silica-magnesia, and silica-titania.

12. The method of claim 1 wherein the hydroprocessing step comprises processing the third fraction in a hydrocracking reactor.

13. The method of claim 12 wherein the catalyst comprises a cracking catalyst for the production of midbarrel products boiling between 150° C. and 355° C. (302° F. and 671° F.).

14. The method of claim 13 wherein the fuel product comprises jet fuel boiling between 175° C. and 260° C. (347° F. and 500° F.) and containing no more than 20 vol.% aromatic components and a naphtha fraction containing no more than 1 ppmw nitrogen containing components and 1 ppmw sulfur containing components.

15. The method of claim 12 wherein the hydroprocessing step comprises contacting the third fraction with a cracking catalyst for the production of gasoline and naphtha.

16. The method of claim 11 wherein the hydroprocessing step comprises contacting the third fraction with a bed of hydrotreating catalyst and then contacting the hydrotreated third fraction with a hydrocracking catalyst.

17. A method for upgrading a hydrocracked residua comprising:

separating a hydrocracked residua into a first fraction containing no more than 20 vol.% aromatic components and a second fraction containing at least 50 vol.% aromatic components;

catalytically hydrotreating the first fraction to produce a hydrotreated product;

distilling the second fraction under vacuum, to produce a third fraction containing between 25 and 50 wt.% aromatic components and a residua fraction;

catalytically hydroprocessing the third fraction in the presence of a cracking catalyst for the production of midbarrel products boiling between 150° C. and 355° C. (302° F. and 671° F.) to produce a hydroprocessed product; and combining said hydrotreated product with said hydroprocessed product to produce a product of which is distillable into a fuel product boiling between 175° C. and 260° C. (347° F. and 500° F.), the fuel product containing no more than 20 vol.% aroamtic components and b) a naphtha fraction containing no more than 1 ppmw sulfur-containing components and 1 ppmw nitrogen containing components.

18. The method of claim 17 wherein the separation step comprises heating the hydrocracked residua to a temperature between about 295° and 395° C. (563° and 743° F.) to produce a gaseous first fraction and a liquid section fraction.

19. The method of claim 17 wherein the catalytic hydrotreating step comprises contacting the first fraction with a catalyst comprising a Group VII metal and a Group VIB metal supported on a refractory oxide.

20. The method of claim 19 wherein said Group VIII metal is selected from the group consisting of nickel and cobalt, and a Group VIB metal is selected from the group consisting of molybdenum and tungsten.

21. The method of claim 19 wherein said refractory oxide is selected from the group consisting of alumina, silica-alumina, silica, titania, magnesia, zirconia, beryllia, silica-magnesia, and silica-titania.

22. The method of claim 18 including degassing the section fraction before separating the second fraction on the vacuum distillation means.

23. The method of claim 18 wherein distillation step comprises vacuum distilling the second fraction at a pressure between about 1.67 and 10.02 KPa (0.5 and 6 inches of Hg).

24. The method of claim 18 wherein the hydroprocessing step comprises introducing the third fraction into a hydrotreating reactor.

25. The method of claim 24 wherein said hydrotreating reactor contains a hydrotreating catalyst having Group VIII metal and a Group VIB metal supported on a refractory oxide.

26. The method of claim 25 wherein said Group VIII metal is selected from the group consisting of nickel and cobalt, and a Group VIB metal is selected from the group consisting of molybdenum and tungsten.

27. The method of claim 26 wherein said refractory oxide is selected from the group consisting of alumina, silica-alumina, silica, titania, magnesia, zirconia, beryllia, silica-magnesia, and silica-titania.

* * * * *

UNITED STATES PATENT AND TRADEMARK OFFICE

CERTIFICATE OF CORRECTION

PATENT NO. : 5,203,987

DATED : April 20, 1993

INVENTOR(S) : Emiliano de la Fuente

It is certified that error appears in the above-identified patent and that said Letters Patent is hereby corrected as shown below:

Title Page
[56] References Cited
Replace "4,675,274" with -- 4,165,274 --.

Claim 1, column 11, line 9, delete the word "at".

Claim 16, column 12, line 11, replace "11' with -- 1 --.

Claim 17, column 12, line 34, after "product" insert the following -- at least 20 vol. % --.

Claim 17, column 12, line 35, after "into" insert -- a) --.

Claim 19, column 12, line 49, replace "VII" with -- VIII --.

Signed and Sealed this

Third Day of May, 1994

Bruce Lehman

*Attest:*

BRUCE LEHMAN

*Attesting Officer*

*Commissioner of Patents and Trademarks*